US012004605B2

(12) United States Patent
Haugen

(10) Patent No.: US 12,004,605 B2
(45) Date of Patent: Jun. 11, 2024

(54) WATERPROOF BOOT TO PANT CONNECTION

(71) Applicant: W. L. Gore & Associates, Inc., Newark, DE (US)

(72) Inventor: Darrin Haugen, Newark, DE (US)

(73) Assignee: W.L. Gore & Associates, Inc., Newark, DE (US)

( * ) Notice: Subject to any disclaimer, the term of this patent is extended or adjusted under 35 U.S.C. 154(b) by 25 days.

(21) Appl. No.: 17/137,938

(22) Filed: Dec. 30, 2020

(65) Prior Publication Data

US 2021/0196009 A1 Jul. 1, 2021

Related U.S. Application Data

(60) Provisional application No. 62/955,051, filed on Dec. 30, 2019.

(51) Int. Cl.
*A44B 18/00* (2006.01)
*A41D 17/00* (2006.01)
(Continued)

(52) U.S. Cl.
CPC ..... *A44B 18/0049* (2013.01); *A41D 27/00* (2013.01); *A41F 1/00* (2013.01); *A41D 17/005* (2013.01); *A41D 2300/324* (2013.01)

(58) Field of Classification Search
CPC .... A41F 1/00; A41F 1/08; A41F 1/008; A41F 17/00; A41D 17/005; A41D 2300/324;
(Continued)

(56) References Cited

U.S. PATENT DOCUMENTS 2,097,200 A * 10/1937 Menutole ..... A43B 3/18 36/1.5
2,813,272 A * 11/1957 Hagan ..... A41D 13/0005 285/260
(Continued)

FOREIGN PATENT DOCUMENTS

GB 2144970 4/1987
GB 2304026 A * 3/1997 ..... A41D 13/0005
(Continued)

*Primary Examiner* — Aiying Zhao
(74) *Attorney, Agent, or Firm* — GREENBERG TRAURIG, LLP

(57) ABSTRACT

An article includes a first garment, a second garment, and a waterproof fastener system configured to join the first garment to the second. The waterproof fastener includes: a first annular gasket, coupled to the first garment, the first annular gasket including a flexible substrate and a continuous groove radially oriented on the first garment such that an engagement direction thereof is oriented perpendicular to a longitudinal direction of the first garment, and a second annular gasket coupled to the second garment, the second annular gasket including a second flexible substrate and a continuous rib radially oriented on the second garment such that an engagement direction thereof is oriented perpendicular to a longitudinal direction of the second garment. The continuous groove is configured to receive the continuous rib to form a waterproof interference fit.

11 Claims, 7 Drawing Sheets

(51) Int. Cl.
*A41D 27/00* (2006.01)
*A41F 1/00* (2006.01)

(58) Field of Classification Search
CPC ..... A41D 2300/322; A41D 1/06; A41D 2400/44; A41D 13/0005; A41D 19/0089; A43B 23/06; A43B 7/12; A44B 18/0049; A44B 18/0019; A43C 19/00; A62B 17/001
See application file for complete search history.

(56) References Cited

U.S. PATENT DOCUMENTS 3,440,696 A * 4/1969 Staller ..... B29D 5/10 24/DIG. 39
3,744,158 A 7/1973 Walker
3,918,131 A 11/1975 Ausnit
4,542,597 A 9/1985 Baptista et al.
4,558,467 A * 12/1985 Barditch ..... G21F 3/02 976/DIG. 336
5,090,057 A * 2/1992 Aldridge ..... A62B 17/001 2/232
5,351,369 A 10/1994 Swain
5,542,766 A 8/1996 Cadwallader
6,651,257 B2 11/2003 Smith
7,062,786 B2 6/2006 Stinton
7,225,470 B1 6/2007 Bradford
7,574,780 B2 8/2009 Meager
7,832,065 B2 11/2010 Meager
7,908,767 B1 3/2011 Mordecai et al.
8,028,351 B2 10/2011 Stachler
9,648,912 B2 5/2017 Alexsson
2003/0188368 A1* 10/2003 Stinton ..... A41D 13/012 2/2.16
2004/0064972 A1 4/2004 Chen et al.
2007/0082165 A1 4/2007 Barrett
2008/0124008 A1* 5/2008 Meager ..... A44B 19/16 383/97
2008/0271298 A1* 11/2008 Meager ..... A41F 1/00 24/589.1
2009/0211852 A1 8/2009 Hannon et al.
2010/0175230 A1 7/2010 Kelsey et al.
2010/0223712 A1* 9/2010 Stachler ..... A62B 17/003 2/311
2011/0047675 A1 3/2011 Aldridge
2016/0198782 A1 7/2016 Thompson
2017/0340276 A1* 11/2017 Noorzai ..... A43B 5/10

FOREIGN PATENT DOCUMENTS

JP 2012065777 A * 4/2012 ..... A41D 13/0005
WO WO-97/05797 2/1997

* cited by examiner

WATERPROOF BOOT TO PANT CONNECTION

FIELD OF THE DISCLOSURE

The present invention relates to a fastening device that creates a waterproof seal between garments, fabrics and other materials.

BACKGROUND OF THE DISCLOSURE

Hunters and outdoor enthusiasts frequently encounter water crossings when hiking or hunting. If the water is higher than the top of a waterproof piece of footwear the user will get water inside the boots. This leads to wet feet, heat loss, and increases the chance of blisters through softening of wet skin. If the water temperature and/or outside temperature is cold enough it can also present a serious safety issue through rapid heat loss and difficulty to warm up the lower extremities. Conventionally, a hiker needs to remove boots, socks and possibly pants or outerwear if the water is high enough to keep from getting their gear wet. This leads to carrying extra "water shoes" or crossing barefoot in difficult rocky and/or swift water conditions with potentially heavy packs. It also greatly reduces the users' rate of travel in the mountains due to the time required to don/doff boots, socks and pants at each water crossing. It is not uncommon to have multiple crossings per day so that water crossings represent an inconvenience and potential safety issue depending upon weather and water conditions. Thus, there is a need for a fluid-tight connection that joins a piece of footwear to a pant through a waterproof reusable seal.

SUMMARY OF THE DISCLOSURE

The terms "disclosure," "the disclosure," "this disclosure" and "the present disclosure," as used in this document, are intended to refer broadly to all of the subject matter described herein or to limit the meaning of the scope of the patent claims below. This summary is a high-level overview of various aspects of the disclosure and introduces some of the concepts that are further detailed in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Exemplary embodiments of this disclosure relate to an article including a first garment, a second garment, and a waterproof fastener system configured to join the first garment to the second garment. The waterproof fastener includes: a) a first annular gasket coupled to the first garment, the first annular gasket including a flexible substrate and at least one continuous groove. The at least one continuous groove projects radially into the first flexible substrate such that an engagement direction of the at least one continuous groove is oriented perpendicular to a longitudinal direction of the first garment. The waterproof fastener also includes: b) a second annular gasket coupled to the second garment, the second annular gasket including a second flexible substrate and at least one continuous rib. The at least one continuous rib projects radially from the second flexible substrate such that an engagement direction of the at least one continuous rib is oriented perpendicular to a longitudinal direction of the second garment. The at least one continuous groove is configured to receive the at least one continuous rib to form a waterproof interference fit. The second annular gasket includes a pull tab extending from a portion thereof, the pull tab being configured to decouple the first and second annular gaskets when a pull force is applied. The first annular gasket includes a locator including a proximal surface, the locator positioned on the first annular gasket such that when a distal end of the second annular gasket abuts the proximal surface, the rib and the groove are aligned.

In some embodiments, the first garment or the second garment comprises an inner liner and an outer portion.

In some embodiments, the second annular gasket is coupled to the inner liner of the second garment.

In some embodiments, the outer portion is configured to cover and extend past the waterproof fastener system when the first and second annular gaskets are engaged.

In some embodiments, at least a portion of the first and second garments comprises at least one of waterproof materials, waterproof breathable materials, thermally protective waterproof breathable materials or materials that provide protection against chemical and/or biological threats.

In some embodiments, the first and the second garments comprise waterproof breathable laminates.

In some embodiments, the fastener system does not include a slider, or any mechanism configured to mate the at least one continuous rib with the at least one continuous groove around the circumference of the at least one continuous rib and/or at least one continuous groove.

In some embodiments, the first annular gasket comprises a locator including a proximal surface, the locator positioned on the first annular gasket such that when a distal end of the second annular gasket abuts the proximal surface, the at least one continuous rib and the at least one continuous groove are aligned.

In some embodiments, the first and second annular gaskets are configured such that the at least one continuous rib is received in the at least one continuous groove via an applied radial force, wherein the applied radial force is perpendicular to a tensile force applied to the waterproof fastener system by the first garment and the second garment during use.

Exemplary embodiments of the present disclosure also relate to a system including a first garment, a second garment, and a waterproof fastener system configured to join the first garment to the second garment. The waterproof fastener system includes a first annular gasket coupled to the first garment, the first annular gasket comprising a flexible substrate and at least one continuous groove. The at least one continuous groove projects radially into the first flexible substrate such that an engagement direction of the at least one continuous groove is oriented perpendicular to a longitudinal direction of the first garment. The waterproof fastener system also includes a second annular gasket coupled to the second garment, the second annular gasket comprising a second flexible substrate and at least one continuous rib. The at least one continuous rib projects radially from the second flexible substrate such that an engagement direction of the at least one continuous rib is oriented perpendicular to a longitudinal direction of the second garment. The at least one continuous groove is configured to receive the at least one continuous rib to form a waterproof interference fit. The second annular gasket comprises a pull tab extending from a portion thereof, the pull tab being configured to decouple the first and second annular gaskets when a pull force is applied.

In some embodiments, the first garment is an article of footwear and the second garment is a pair of pants including two pant legs.

In some embodiments, the first garment is a glove and the second garment is a jacket or shirt.

In some embodiments, the first garment is a pair of pants and the second garment is a jacket or a shirt.

In some embodiments, the first garment is a vest and the second garment is a sleeve.

In some embodiments, the first garment is a part of a pair of pants and the second garment is another part of the pair of pants.

In some embodiments, the first garment is a boot, wherein the boot comprises a gaiter, and wherein each pant leg includes an inner liner and an outer shell.

In some embodiments, the gaiter is coupled to the first annular gasket and the inner liner is coupled to the second annular gasket.

Exemplary embodiments of the present disclosure also relate to an article including a first garment, a second garment, and a waterproof fastener system configured to join the first garment to the second garment. The waterproof fastener system includes a first annular gasket coupled to the first garment, the first annular gasket comprising a flexible substrate and at least one continuous groove. The at least one continuous groove projects radially into the first flexible substrate such that an engagement direction of the at least one continuous groove is oriented perpendicular to a longitudinal direction of the first garment. The waterproof fastener system also includes a second annular gasket coupled to the second garment, the second annular gasket comprising a second flexible substrate and at least one continuous rib. The at least one continuous rib projects radially from the second garment such that an engagement direction of the at least one continuous rib is oriented perpendicular to a longitudinal direction of the second garment. The at least one continuous groove is configured to receive the at least one continuous rib to form a waterproof interference fit.

In some embodiments, the first and second annular gaskets are welded to form a permanent seal.

In some embodiments, the first and second annular gaskets are one of thermally or ultrasonically welded.

In some embodiments, the first and second annular gaskets are configured such that the at least one continuous rib is received in the at least one continuous groove via an applied radial force, wherein the applied radial force is perpendicular to a tensile force applied to the waterproof fastener system by the first garment and the second garment during use.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the present disclosure.

DETAILED DESCRIPTION

Figures 1A, 1B:
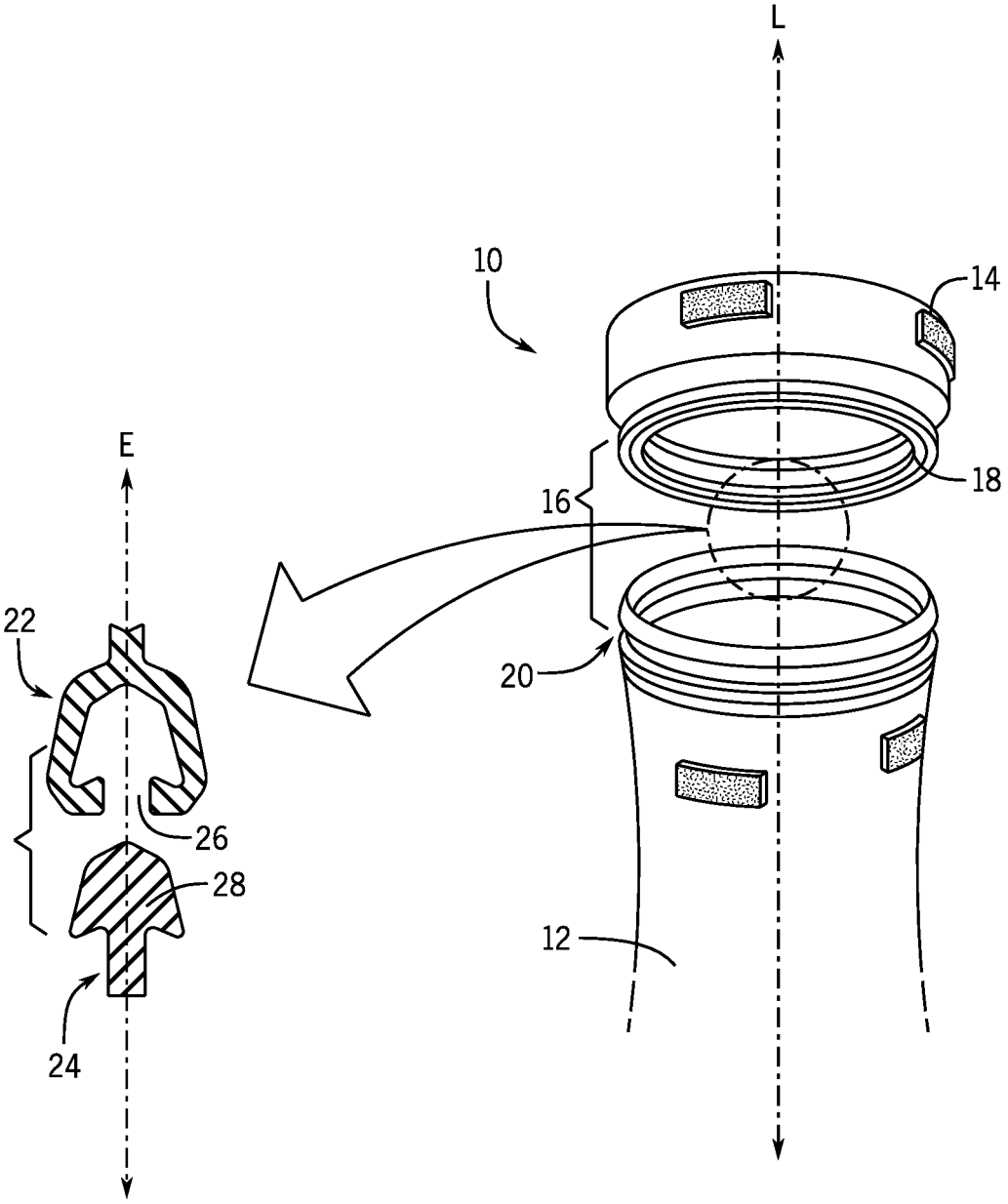
FIG. 1B (PRIOR ART)
FIG. 1A (PRIOR ART)
FIG. 1A is a perspective view of a conventional fastener system.
FIG. 1B is an enlarged perspective view of annular interlocks of the fastener system of FIG. 1A.

Persons skilled in the art will readily appreciate that various aspects of the present disclosure can be realized by any number of methods and apparatus configured to perform the intended function. It should also be noted that the description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. As used herein, the terms "proximal" and "distal" are intended to refer to a direction toward (proximal) and away from (distal) a user of the invention.

For purposes of this disclosure, the term "article" as used herein refers to any article of clothing comprising at least one garment.

For purposes of this disclosure, the term "continuous" as used herein refers to an unbroken whole without interruption.

For purposes of this disclosure, the term "flexible" as used herein refers to a substrate that can be bent without breaking, cracking or permanently deforming.

For purposes of this disclosure, the term "groove" as used herein refers to a concave geometry with an undercut, such as a channel, configured to mate with and receive a rib via an interference fit.

For purposes of this disclosure, the term "interference fit" as used herein refers to a fit between two parts in which the external dimension of one part is similar to (no more than +/−5%, or no more than +/−10%) the internal dimension of the part into which it has to fit.

For purposes of this disclosure, the term "rib" as used herein refers to a raised portion of a surface or structure configured to mate with and be inserted into a groove.

For purposes of this disclosure, the term "waterproof" as used herein refers to the waterproofness of at least the fastener system described herein, where the fastener system is subjected to the Suter test as known in the art and described herein. The sample tested and described below includes a portion of the any fabric adjacent to the fastener and at least a portion of the fastener, including intersections wherein the fabric is coupled to the fastener system. The Suter test is based generally on ISO 811-1981. This procedure provides a low pressure challenge to a sample being tested and observing the other side for indication of water penetration through the sample.

A portion of the fastener system (in a sealed or water-tight configuration) is clamped and sealed between rubber gaskets in a fixture that holds the sample so that water can be applied to an area of the sample about 7.62 centimeters (cm) in diameter. The water is applied under air pressure of about 0.21 bar to one side of the sample. In testing the sample, water is applied to the face or outer side of the sample and the opposite side is observed for leaks, either by wicking or by the appearance of droplets) for 3 minutes. If no water is observed, the sample has passed the test and the sample is considered to have a water entry pressure of greater than 0.21 bar.

As described herein, a fastener system is provided for joining garments to create a waterproof seal between garments. A "garment", as defined herein, includes, but is not limited to, articles of footwear and clothing such as, for example, a shoe, a boot, a pair of pants, a glove, a jacket, a vest, a shirt sleeve, and a shirt. The fastener system includes two interlocking gaskets having mating profiles forming an interference fit between the two garments when joined. In particular, the fastener system of the present disclosure provides several means of creating a substantially water-resistant, waterproof, thermally protective, and/or breathable seal. In some embodiments, one or more pull tabs are provided for decoupling of the gaskets after use. As provided herein, the fastener system may include a locator providing an indication that the two gaskets are aligned and can be engaged to provide the interference fit.

The present disclosure provides several advantages over the prior art. For example, the fastener system is waterproof and, as such, eliminates the need for coverings over the gaskets of the garments. In addition, the fastener system may be formed from non-metallic materials, therefore making the fastener lightweight and inexpensive. As such, these materials provide a fastener that has less tendency to jam or create unwanted noise. Additionally, the gaskets of the present fastener system are sealed by the application of pressure, not by a slider. This sealing technique thus provides improved accessibility and a closer fit between the two gaskets, as compared to a slider seal system. Other prior art systems provide a first garment piece where an annular gasket is provided on one a distal end of the first garment piece and a second annular gasket is provide on a proximate end of a second garment piece and the waterproof connection is made by sealing one gasket into the second gasket. The challenge with this system is that during use, there are considerable tensile forces exerted on the joined first and second gaskets that are oriented to pull the two gaskets apart. Thus, a second closure system is provided to help maintain the engagement of the gasket members. Further, the present disclosure has many applications. The fastener system is capable of being used with any article of clothing, especially those used in activities that encounter wind and water, such as mountaineering, hiking, fishing or boating. The interference sealing surfaces of the present disclosure are oriented so that the tensile forces during use do not pull the annular gaskets apart, thus providing a sealing system less likely to unseal during use.

With reference to FIGS. 1A-1B, a conventional protective article 10 is shown to include a protective boot 12, a protective pant leg 14, and a gasket system 16. The gasket system 16 includes a first annular gasket 18 coupled to the protective pant leg 14, and a second annular gasket 20 coupled to the protective boot 12. The first and second annular gaskets 18, 20 include engageable first and second annular interlocks 22, 24, respectively, that maintain engagement of the first and second annular gaskets 18, 20. As depicted in FIGS. 1A, 1B, in the gasket system 16, the interlocks 22, 24 encircle the wearer's leg and engage each other to form a seal, with the first annular interlock 22 having a downwardly opening annular channel 26 and the second annular interlock 24 having an upwardly directed annular bead 28 that is received in and interlocked with the channel 26. Specifically, an engagement direction E of the first annular interlock 22 with the second annular interlock 24 is parallel to a longitudinal direction L of the gasket system 16. Because of this axial orientation of the first and second annular interlocks 22, 24, when the conventional protective article 10 is worn by the wearer, tension is applied to the first and second annular interlocks 22, 24 along the engagement direction E. As a result, this tension on the first and second annular interlocks 22, 24, may cause the first and second annular interlocks 22, 24 to inadvertently disengage during use.

With reference to FIGS. 2-6, a protective article 100 of the current disclosure provides an improved fastener system 140 for joining garments that is not affected by the tension applied along the longitudinal direction L during use. Specifically, the protective article 100 includes a first protective garment 101, a second protective garment 104, and a waterproof fastener system 140. The fastener system 140 is configured to join the first protective garment 101 to the second protective garment 104. In one embodiment, the first protective garment 101 is a protective boot 102 while the second protective garment 104 includes two pant legs 106, the waterproof fastener system 140 associating each pant leg 106 with a boot 102. The second protective garment 104 may be any of a pair of protective pants, a pair of protective overalls, waders, and/or a pair of protective coveralls. Although the embodiment of FIGS. 2-6 relates to the joining of a boot to a protective garment with pant legs, the fastener system may be used to join any two garments. For example, in an exemplary embodiment, the first protective garment is a pair of gloves while the second protective garment is a jacket or a shirt. In another exemplary embodiment, the first protective garment is a pair of pants while the second protective garment is a jacket or a shirt. In another exemplary embodiment, the first protective garment is a vest while the second protective garment is a sleeve. In another exemplary embodiment, the first protective garment can be a portion of a pair of pants while the second protective garment is another portion of the pair of pants. For example, in such an embodiment, a portion of the pant legs can be replaceable. In such an embodiment, the portion of the pant legs can be a lower portion (e.g., below a knee region of the pants) or an upper portion (e.g., above the knee region of the pants). Such an embodiment may enable replacement of parts of the pair of pants that wear out over time, for example.

In some embodiments, each pant leg 106 includes an outer shell 108 and an inner liner 110. The outer shell and the inner liner 110, in some embodiments, comprise a material that is waterproof, breathable, thermally protective, chemically protective (e.g., capable of preventing direct skin contact and contamination), biologically protective (e.g., capable of protecting from biological agents), or a combination thereof. For example, the inner liner 110 comprises materials or laminates including, but not limited to, textiles, for example, wovens, knits, nonwovens and films. The inner layer may also be a laminate comprising one or more textile layers and one or more waterproof, breathable layers, for example, Gore-Tex® films, expanded polytetrafluoroethylene, polyolefins, expanded polyolefins, polyethylene, expanded polyethylene, polypropylene, expanded polypropylene, fluoropolymers, expanded fluoropolymers or a combination thereof. In some embodiments, the inner liner 110 is a laminate and, more specifically, a waterproof, breathable laminate. In other embodiments, the inner liner 110 is a 3-layer laminate comprising two textile layers and a waterproof, breathable layer sandwiched in between the textile layers. Although not illustrated, one or both of protective garments 101 and 104 can also include a thermally insulative liner made of any suitable thermal insulating material or construction.

In some embodiments, the boot 102 includes a lower foot portion 112 and a gaiter 114 coupled to and extending proximally from a proximal end of the lower foot portion 112. The lower foot portion 112 is a typical footwear material and construction and can be made of any suitable footwear material or footwear laminates including, but not limited to, one or more layers of natural or synthetic leather, rubberized fabric and/or a suitable rubber material, textiles, wovens, knits, nonwovens, insulation materials, expanded polytetrafluoroethylene, polyolefins, expanded polyolefins, polyethylene, expanded polyethylene, polypropylene, expanded polypropylene, fluoropolymers, expanded fluoropolymers or a combination thereof, or any other suitable material that will be resistant to the passage of liquid through the exterior of the boot to contact the wearer. The gaiter 114 may comprise a material that is waterproof, breathable, thermally protective, chemically protective, biologically protective, or a combination thereof. For example, the gaiter 114 comprises materials or laminates including, but not limited to textiles, for example, wovens, knits, nonwovens and films. The gaiter 114 may also be a laminate comprising one or more textile layers and one or more waterproof, breathable layers, for example, Gore-Tex® films, expanded polytetrafluoroethylene, polyolefins, expanded polyolefins, polyethylene, expanded polyethylene, polypropylene, expanded polypropylene, fluoropolymers, expanded fluoropolymers or a combination thereof. In some embodiments, the gaiter 114 is a laminate and, more specifically, a waterproof, breathable laminate. In other embodiments, the gaiter 114 is a 3-layer laminate comprising two textile layers and a waterproof, breathable layer sandwiched in between the textile layers. The gaiter 114, in some embodiments, is sufficiently flexible so as to be rolled down when the fastener system 140 is not in use.

As best seen in FIGS. 3-6, in one exemplary embodiment, the fastener system 140 includes a first annular gasket 116 coupled to the gaiter 114 of each boot 102 and a second annular gasket 118 coupled to the inner liner 110 of each pant leg 106 of the protective garment 104. The first and second annular gaskets 116, 118 are configured to engage with each other to form a closed loop vapor and moisture barrier seal when the leg of a wearer is received in the corresponding pant leg 106 and boot 102. The first and second annular gaskets 116, 118 may be coupled to the boot 102 and pant leg 106, respectively, by any known technique. For example, the first and second annular gaskets 116, 118 may be sewn, welded, glued, taped, etc. to the respective pant leg 106 or boot 102. Although the boot of the present embodiment includes a gaiter, in other exemplary embodiments, a boot without a gaiter may be used. In these embodiments, the first annular gasket 116 is directly coupled to the lower foot portion at, for example, a collar of the boot.

In some embodiments the first annular gasket 116 includes at least one continuous channel or groove 120 extending longitudinally along an entire circumference of the first annular gasket 116, forming a receiving portion of the waterproof seal. The second annular gasket 118 includes at least one continuous rib 122 extending longitudinally along an entire circumference of the second annular gasket 116. The second annular gasket 118 is adapted for operatively engaging the first annular gasket 116 to facilitate the formation of a waterproof seal. Specifically, the rib 122 of the second annular gasket 118 is adapted to engage the groove 120 of the first annular gasket 116 when the first and second annular gaskets 116, 118 are operatively engaged.

In some embodiments, the groove 120 and the rib 122 are positioned such that, in use, each of the groove 120 and the rib 122 extend or project radially about the fastener system 140. Specifically, in an engaged configuration, the groove 120 projects radially into the first annular gasket 116 such that an engagement direction $E_g$ of the groove 120 is oriented perpendicular to a longitudinal direction $L_b$ of the boot 102 on which the first annular gasket 116 is positioned. Similarly, the rib 122 projects radially from the second annular gasket 118 such that an engagement direction Er of the rib 122 is oriented perpendicular to a longitudinal direction $L_p$ of the pant leg 106 on which the second annular gasket 118 is located. Thus, when the rib 122 is mated into the groove 120 their seal is oriented radially, rather than axially, as in the conventional protective article 10 of FIGS. 1A, 1B. Because of this radial seal, the force applied to mate and unmate the groove 120 and rib 122 is a radial force. In contrast, the force that is generally applied to the fastener system 140 during use is a tensile force that is parallel to the longitudinal axes of the boot 102 and pant leg 206 and perpendicular to the radial force required to seal the fastener system 140. Therefore, the tensile force is not applied in such a direction that it acts to unmate the rib 122 from the groove 120.

Upon sealing of the first and second annular gaskets 116, 118, the rib 122, which may be of similar or same size, shape, and configuration as the groove 120, will be adapted to fit snugly inside the groove 120. Thus, upon insertion of the rib 122 into the groove 120, the first and second annular gaskets 116, 118 will be forced to be aligned properly (e.g., in order to form a seal). If the rib 122 does not fit properly into the groove 120 this indicates that the first and second annular gaskets 116, 118 are not aligned properly. Thus, the rib 122 and groove 120 act as a safeguard against improper operation of the fastener system 140.

In some embodiments, the groove 120 and the rib 122 have cross-sectional shapes that define conforming surfaces that engage against each other to form the waterproof seal. For example, in one embodiment illustrated in FIG. 4, the rib 122 has an enlarged head 134 with a rounded cross-sectional shape. The enlarged head 134 narrows to a neck 136, forming rounded shoulders 138. The groove 120 has an interior surface that conforms to the surface of the rib 122. Specifically, the groove 120 has an enlarged portion 154 with a rounded cross-sectional shape that tapers to a mouth 156 configured to receive the enlarged head 134 of the rib 122. The tapering of the enlarged portion 154 to the mouth 156 forms shoulders 158 that engage with the shoulders 138 of the rib 122 to retain the rib 122 within the groove 120 via an interference fit. That is, the mouth 156 of the groove 120 has a sufficient resiliency to allow the rib 122 to be inserted into the groove 120 and interlocked therein when the enlarged head 134 is snapped therein by, for example, application of pressure by the user's finger. While the present embodiment describes a substantially rounded cross-sectional shape of the rib 122 and groove 120, the rib 122 and groove 120 may have any other cross-sectional shape so long as the two components have mating shapes that provide an interference fit when engaged.

Figure 4:
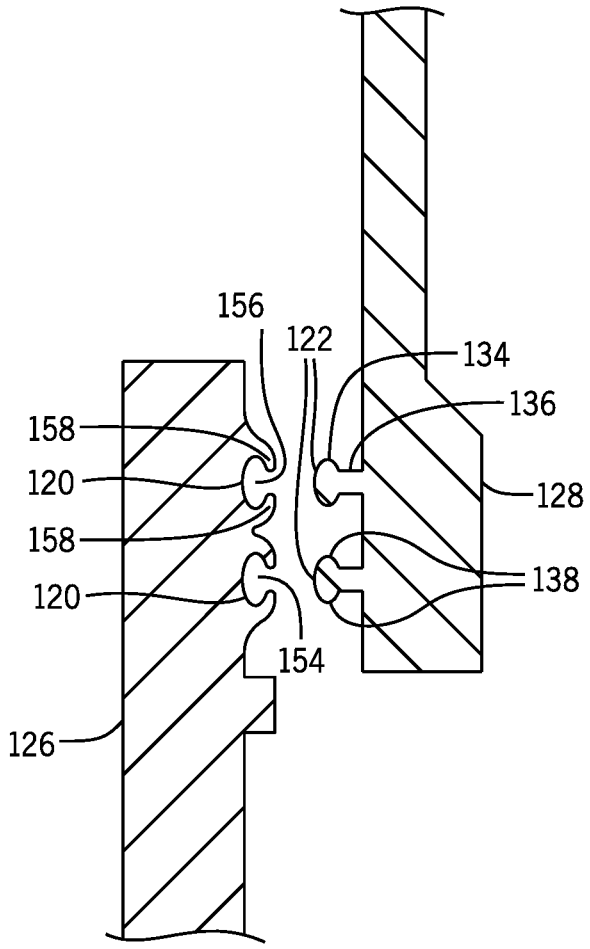
FIG. 4 is a cross-sectional view of a fastener system in an unsealed configuration, in accordance with embodiments described herein.

In some embodiments, multiple grooves 120 and multiple ribs 122 may be used along the length of the first and second annular gaskets 116, 118. The use of multiple grooves 120 and ribs 122 may help to further ensure prevention of pullout of the first and second annular gaskets 116, 118. In an exemplary embodiment, as depicted in FIG. 4, the first annular gasket 116 includes a plurality of continuous grooves 120 extending longitudinally along an entire circumference thereof and the second annular gasket 118 includes a plurality of continuous ribs 122 extending longitudinally along an entire circumference thereof. Although FIG. 4 shows two continuous ribs 122 and two continuous grooves 120, the fastener system 140 may include any number of ribs 122 and grooves 120. In this embodiment, the plurality of grooves 120 are substantially parallel to one another and the plurality of ribs 122 are substantially parallel to one another. The grooves 120 may be spaced equally or at different distances from one another along the first annular gasket 116. Similarly, the ribs 122 may be spaced equally or at different distance from one another along the second annular gasket 118. However, the plurality of ribs 122 and the plurality of grooves 120 should be spaced so that the ribs 122 and the grooves 120 align with one another when the first and second annular gaskets 116, 118 are engaged.

Regardless of the number of rib(s) and groove(s), a variety of geometries may be used for the rib(s) and groove(s). Non-limiting examples include the shape of a circle, trapezoid, triangle, square, rhombus, rectangle, or combinations thereof. Alternatively, the groove is a series of repeating geometries and/or repeating alternating geometries. It is also contemplated that the groove(s) and rib(s) may also relate to each other in planar or linear relation as well as non-planar and non-linear relations. In some embodiments, the fastener system 140 is free from a slider or any similar mechanism configured to mate the rib 122 with the groove 120.

In some embodiments, the rib 122 and the groove 120 are welded together to form a permanent waterproof seal. The rib 122 and the groove 120 may be welded by any known method including, but not limited to, thermal welding, ultrasonic welding, etc. Permanently welding the first garment to the second garment when the rib and the groove are engaged, can provide a garment that provides enhanced protection against water ingress or enhanced protection against chemical or biological threats.

According to some embodiments, the first and second annular gaskets 116, 118 are formed by injection molding. In other embodiments, the first and second annular gaskets 116, 118 are formed by 3-dimensional printing. In still further embodiments, the first and second annular gaskets are formed by extrusion or welding. According to some embodiments, the first and second annular gaskets 116, 118 are not formed by extrusion so that the first and second annular gaskets 116, 118 are seamless. In some embodiments, the first and second annular gaskets 116, 118 are formed from a flexible substrate. The flexible substrate material can include, but is not limited to, thermoplastic polyurethane, polyurethane, polyolefin, polyolefin copolymer, polyethylene, polypropylene, thermoplastic elastomers, styrene ethylene butylene styrene rubber, or a combination thereof.

In use, there are generally two forces acting upon the annular gaskets 116, 118. The first force (i.e., a radial force) is the force required to mate and unmate the first annular gasket 116 and the second annular gasket 118. Once the two gaskets are mated around the periphery of the gaskets 116, 118 and the garment is in use, the force is generally a tensile force that is oriented axial to or approximately 90 degrees to the radial force. Thus, the tensile force during wearing and use does not seek to unmate the mated gaskets 116, 118. In some embodiments, the force required to unmate the gaskets 116, 118 in the radial direction is less than half the force required to unmate the gaskets 116, 118 through tension in the axial direction.

Figure 5:
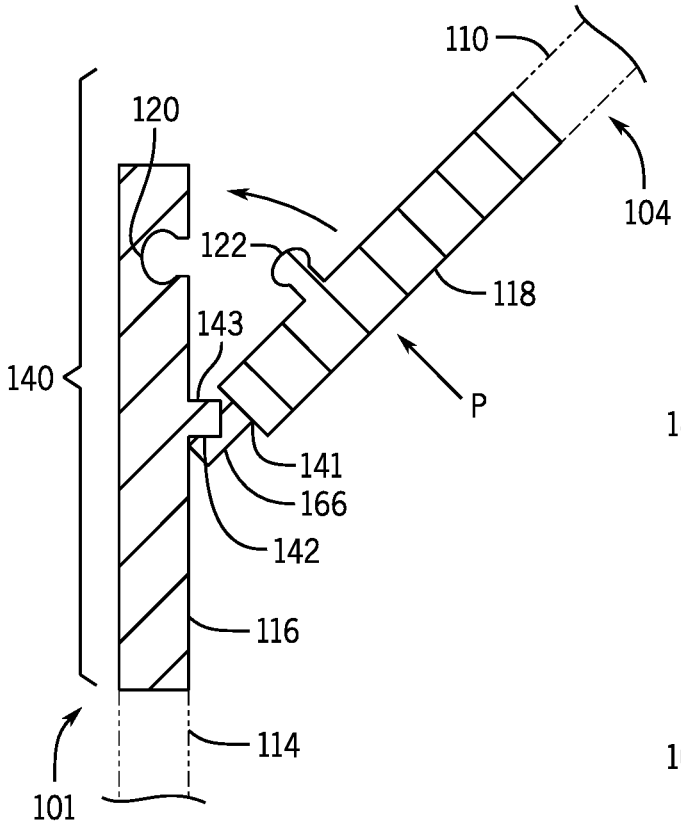
FIG. 5 is a cross-sectional view of a fastener system in an unsealed configuration, in accordance with embodiments described herein.
Figure 6:
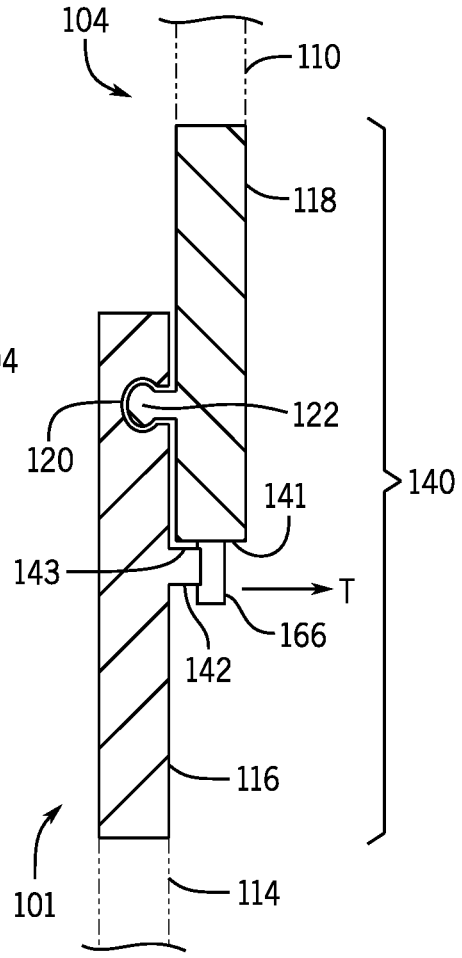
FIG. 6 is a cross-sectional view of a fastener system in a sealed configuration, in accordance with embodiments described herein.
Figure 7:
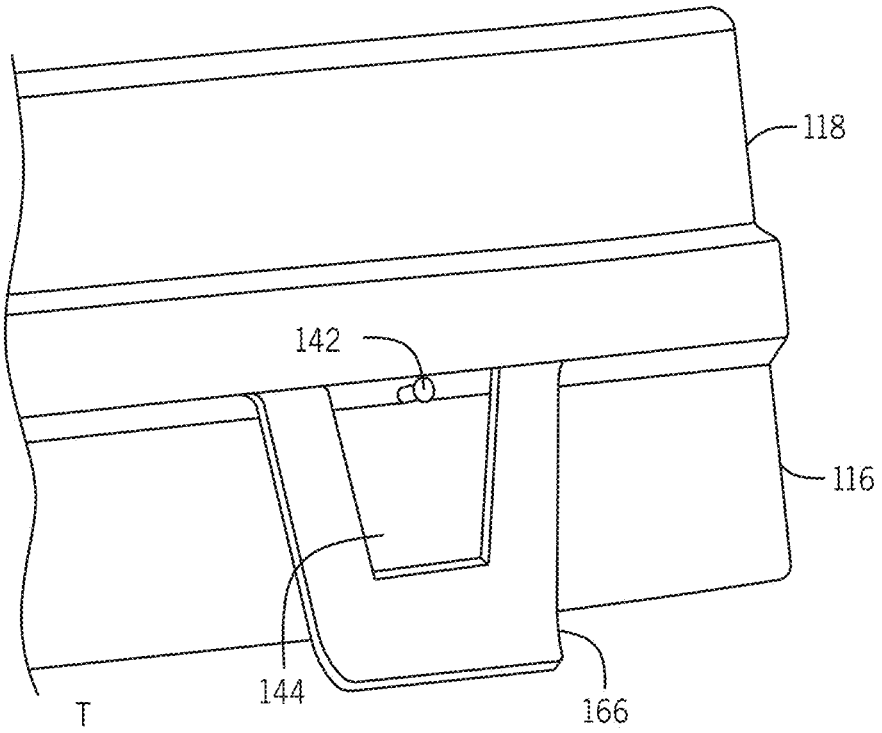
FIG. 7 is a perspective view of a locator of a fastener system, in accordance with embodiments described herein.

According to some aspects of the present disclosure, the fastener system 140 includes a pull tab 166 configured to release the rib 122 from the groove 120. For example, in an embodiment, the second annular gasket 118 includes a pull tab 166 extending from at least a portion thereof, as depicted in FIGS. 5-6. In an embodiment, the pull tab 166 is an extension at an end of the second annular gasket 118. The pull tab 166, in an aspect of the present disclosure, is integrally formed with the second annular gasket 118. In some embodiments, the pull tab 166 is welded to the second annular gasket 118. In some embodiments, the pull tab 166 has a discrete length that is less than the entire circumference of the annular gaskets 118. The pull tab 166 is configured to pull the rib 122 of the second annular gasket 118 out of the groove 120 of the first annular gasket 116 when a pull force is applied thereto to decouple the second annular gasket 118 and the first annular gasket 116 and disconnect the waterproof seal. In some embodiments, as depicted in FIG. 7, the pull tab 166 includes an open central portion or hole 144 configured to facilitate grasping by a finger or thumb of the user.

In some embodiments, the fastener system 140 is free from a slider or any similar mechanism configured to mate the groove 120 with the rib 122.

In some embodiments, the fastener system 140 includes a locator 142 configured to provide an indication that the groove 120 and the rib 122 are aligned for sealing. For example, the locator 142 may indicate that when the distal end 141 of the second annular gasket 118 abuts a proximal surface 143 of the locator 142, as illustrated in FIG. 5, the rib 122 and the groove 120 are aligned and can be engaged to provide the waterproof interference fit. As depicted in the figure, the locator 142 is positioned on the first annular gasket 116 distal to the groove 120. The locator 142 may be any element such as, for example, a cylindrical boss, that has an abutting surface to act as a stop for the second annular gasket 118. The locator 142 is minimal in size so as to prevent catching with any other element of the fastener system 140 or the protective garments 101, 104. In exemplary embodiments, the locator 142 has a radius of approximately 2 mm. In this embodiment, the locator 142 is positioned such that the locator 142 extends through the central hole 144 of the pull tab 166 so that there is no interference therebetween. In other embodiments, the size of the locator 142 is not particularly limited and could be a locator that is relatively small, for example, about 4 square millimeters or may be a locator pin that is present across the entire circumference of the annular gasket 118.

FIGS. 5-6 depict an exemplary sequence of operation of the fastener system 140. At step one, depicted in FIG. 5, the second annular gasket 118 pulled down over the first annular gasket 116 until a distal end 141 thereof abuts the proximal surface 143 of the locator 142. As described above, when the distal end 141 of the second annular gasket 118 abuts the proximal surface 143 of the locator 142, the groove 120 and the rib 122 are correctly aligned for sealing. The first and second annular gaskets 116, 118 are sealed together with finger pressure P at one point along the circumference of the fastener system 140. Pressure may then be applied continuously around the circumference of the first and second annular gaskets 116, 118 to fully seal the fastener system 140.

To disconnect the fastener system 140, as illustrated in FIG. 6, in step two, the user applies a tensile force T to the tab 166 to pull the second annular gasket 118 away from the first annular gasket 116, removing the rib 122 from the groove 120. The first and second protective garments 101, 104 are thereby disengaged.

Figure 2:
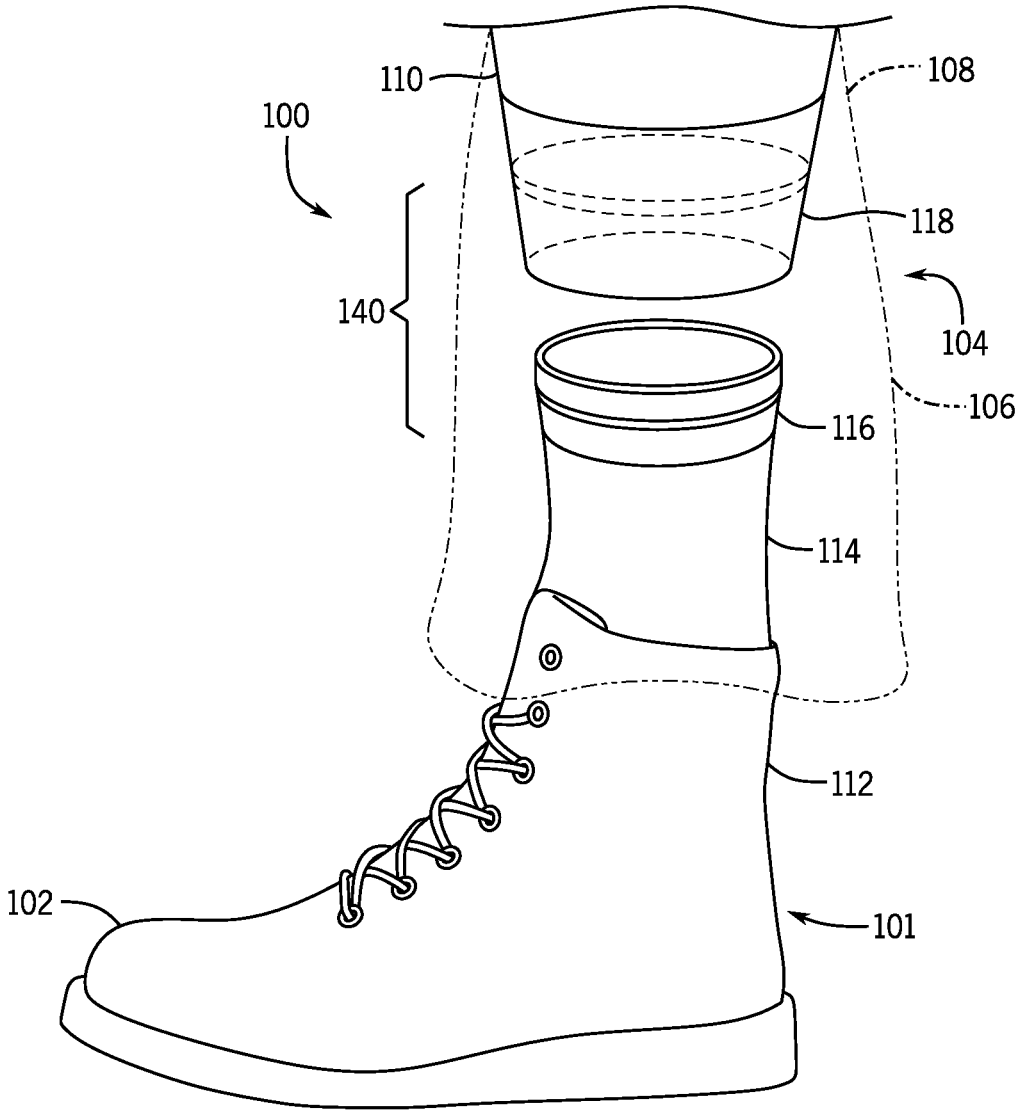
FIG. 2 is a perspective view of a portion of a protective article including a pant leg, boot and a fastener system, in accordance with embodiments described herein.
Figure 3:
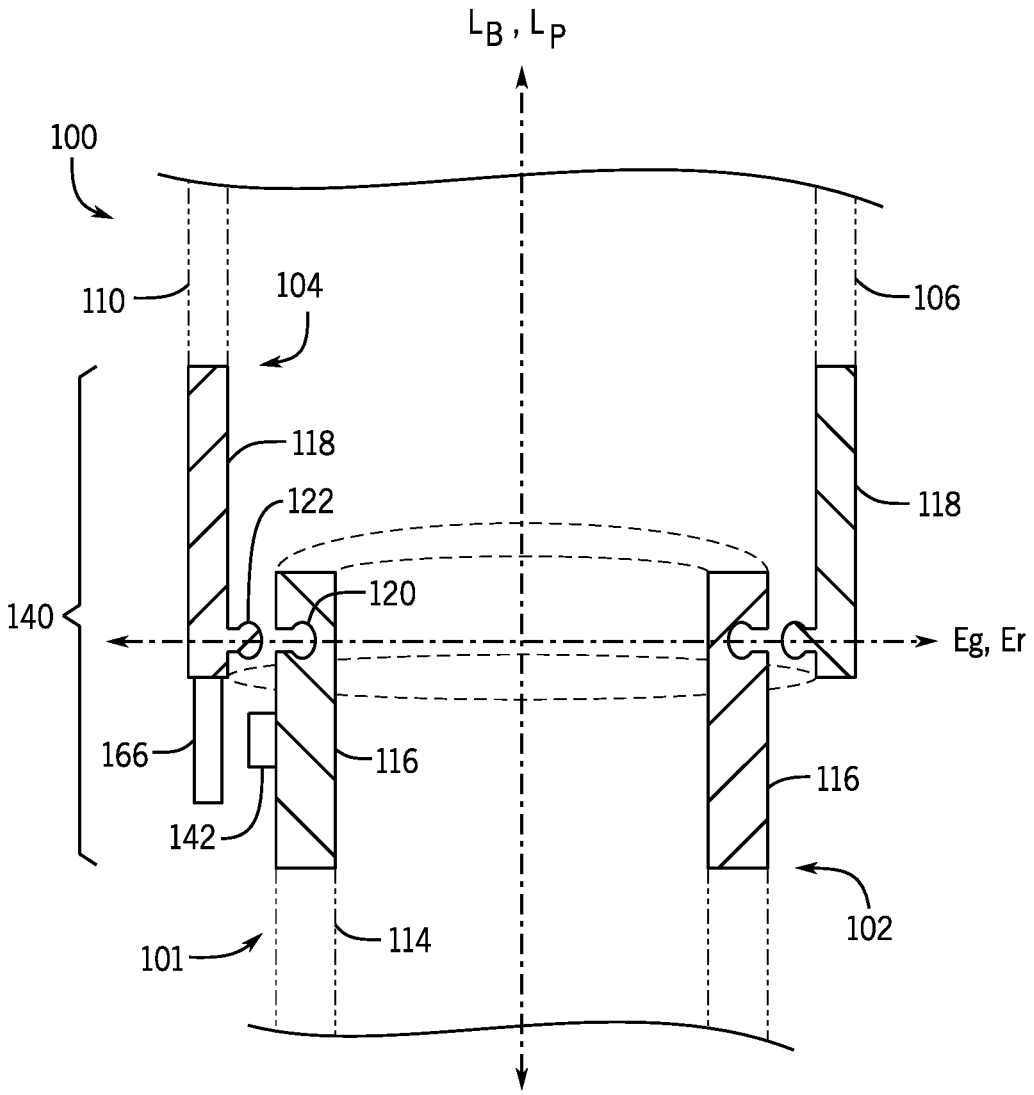
FIG. 3 is a cross-sectional view of a fastener system in an unsealed configuration, in accordance with embodiments described herein.
Figure 8:
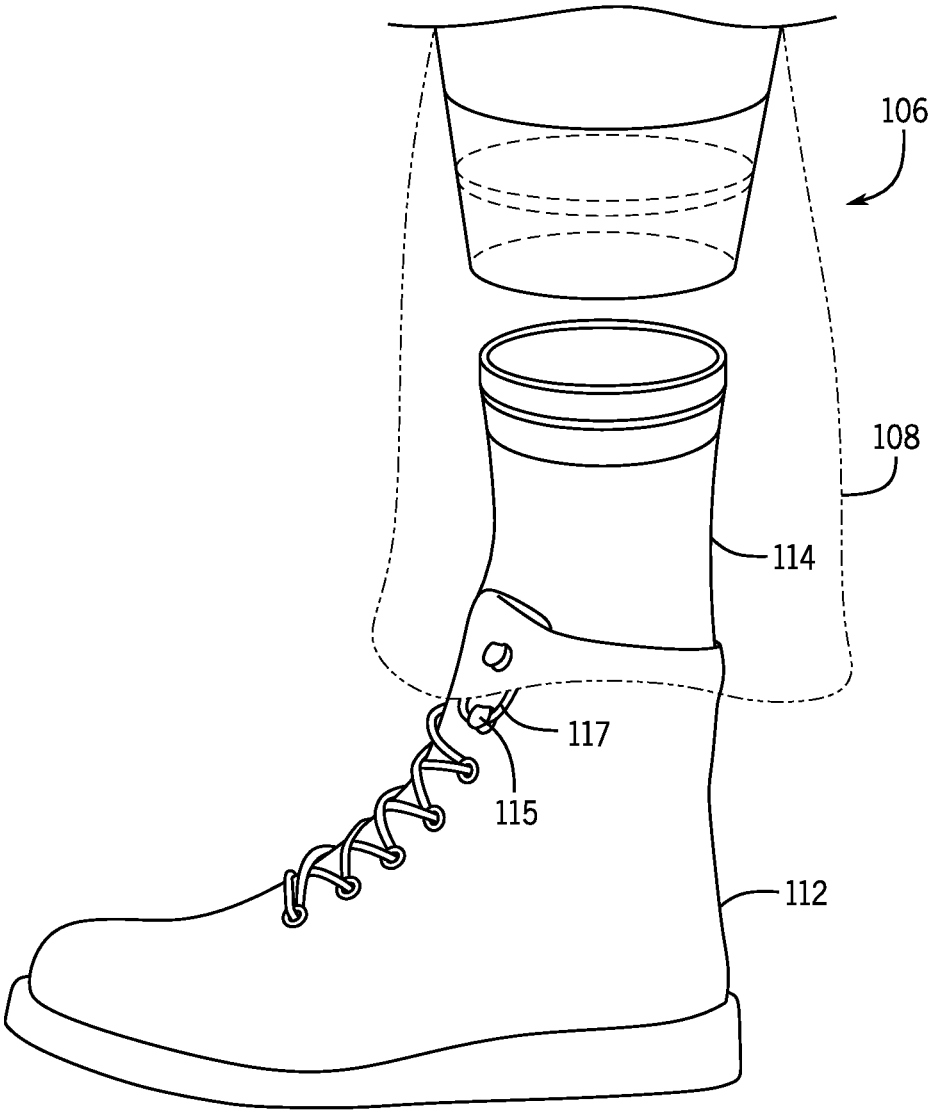
FIG. 8 is a perspective view of a protective article with a lace hook, in accordance with embodiments described herein.

As best seen in FIGS. 2 and 8, the outer shell 108 of each pant leg 106 may be configured as a cuff that extends downwardly to overlay (e.g., cover) the gaiter 114 and, in some embodiments, a portion of the lower foot portion 112. In some embodiments, the outer shell 108 of each pant leg 106 includes, for example, a hook 115 or loop to attach the outer shell 108 to the lower foot portion 112, providing further protection from liquid or other environmental elements. In some embodiments, the hook 115 hooks onto laces 117 of the boot 102. The outer shell 108, when pulled down over the gaiter 114, also protects the fastener system 140 from damage due to external factors. It is noted however, that the hook 115 does not function to maintain the engagement of the fastener systems 140 (not shown in FIG. 8). In some embodiments, the article is free from a hook 115 on one or more portions of the pants leg and/or the boot.

The present disclosure also relates to a kit, wherein the kit comprises two or more first garments and two or more second garments, wherein each of the first garments comprises a first sized garment, a second sized first garment and a subsequently sized first garment (if present) and each second garment comprises a first sized second garment and a second sized second garment and a subsequently sized second garment; and a waterproof fastener system configured to join at least one of the first garments to at least one of the second garments, wherein the waterproof fastener system is the same as described herein. Since persons come in multiple sizes, the kit allows the wearer to choose the correctly sized first and second garments in order to provide a fit to the overall garment that corresponds to the wearer's individual needs or requirements.

The foregoing discussion has been presented for purposes of illustration and description. Further, the description is not intended to limit the invention to the form disclosed herein. Consequently, variation, modification and combination commensurate with the above teachings, within the skill and knowledge of the relevant art, are within the scope of the present disclosure. The embodiments described herein and above are further intended to explain the best mode presently known of practicing the invention and to enable other skilled in the art to utilize the invention, as such, or in other embodiments, and with the various modifications required by their particular application or uses of the invention. It should be further construed that all of the embodiments disclosed herein may be presented individually or in combination to create invention that should be deemed within the scope and teaching of the specification presented herein. It is intended that the appended claims be construed to include alternative embodiments to the extent permitted by the prior art.

What is claimed is:

1. An article comprising:

an article of footwear, a pant leg, and a waterproof fastener system configured to join the article of footwear to the pant leg, wherein the waterproof fastener system comprises:

a) a first annular gasket coupled to the article of footwear, the first annular gasket comprising a first flexible substrate, at least one continuous groove, and a locator, wherein the at least one continuous groove includes an enlarged portion that tapers to a mouth, wherein the at least one continuous groove projects radially into the first flexible substrate such that an engagement direction of the at least one continuous groove is oriented perpendicular to a longitudinal direction of the article of footwear, wherein the locator is positioned on the first flexible substrate, and wherein the locator comprises a proximal surface, and b) a second annular gasket coupled to the pant leg, the second annular gasket comprising a second flexible substrate and at least one continuous rib, wherein the at least one continuous rib includes an enlarged head that narrows to a neck, and wherein the at least one continuous rib projects radially from the second flexible substrate such that an engagement direction of the at least one continuous rib is oriented perpendicular to a longitudinal direction of the pant leg, wherein the enlarged portion of the at least one continuous groove is configured to receive the enlarged head of the at least one continuous rib, wherein the at least one continuous groove is configured to receive the at least one continuous rib to form a waterproof interference fit, wherein the second annular gasket comprises a pull tab extending from a portion thereof, wherein the pull tab includes an open portion extending through a center of the pull tab, and wherein the pull tab is configured to decouple the first and second annular gaskets when a pull force is applied, and wherein the locator is positioned on the first flexible substrate so as to be capable of engaging the open portion in the pull tab, and wherein the locator is configured to engage the open portion in the pull tab, when the at least one continuous rib and the at least one continuous groove are aligned.

2. The article of claim 1 wherein one of the article of footwear or the pant leg comprises an inner liner and an outer portion.

3. The article of claim 2, wherein the pant leg comprises the inner liner and the outer portion, and wherein the second annular gasket is coupled to the inner liner of the pant leg.

4. The article of claim 2, wherein the outer portion is configured to cover and extend past the waterproof fastener system when the first and second annular gaskets are engaged.

5. The article of claim 1, wherein at least a portion of the article of footwear and the pant leg comprises at least one of waterproof materials, waterproof breathable materials, thermally protective waterproof breathable materials or materials that provide protection against chemical and/or biological threats.

6. The article of claim 1, wherein the article of footwear and the pant leg comprise waterproof breathable laminates.

7. The article of claim 1, wherein the fastener system does not include a slider configured to mate the at least one continuous rib with the at least one continuous groove around a circumference of the at least one continuous rib and/or the at least one continuous groove.

8. The article of claim 1, wherein the first and second annular gaskets are configured such that the at least one continuous rib is received in the at least one continuous groove via an applied radial force, wherein the applied radial force is perpendicular to a tensile force applied to the waterproof fastener system by the article of footwear and the pant leg during use.

9. A system comprising:

an article of footwear, a pant leg, and a waterproof fastener system configured to join the article of footwear to the pant leg, wherein the waterproof fastener system comprises:

a) a first annular gasket coupled to the article of footwear, the first annular gasket comprising a first flexible substrate, at least one continuous groove, and a locator, wherein the at least one continuous groove projects radially into the first flexible substrate such that an engagement direction of the at least one continuous groove is oriented perpendicular to a longitudinal direction of the article of footwear, wherein the at least one continuous groove includes an enlarged groove portion that tapers to a mouth configured to receive an enlarged head of at least one continuous rib, wherein the locator is positioned on the first flexible substrate, and wherein the locator comprises a proximal surface, and b) a second annular gasket coupled to the pant leg, the second annular gasket comprising a second flexible substrate and the at least one continuous rib, wherein the at least one continuous rib includes the enlarged head that narrows to a neck, wherein the at least one continuous rib projects radially from the second flexible substrate such that an engagement direction of the at least one continuous rib is oriented perpendicular to a longitudinal direction of the pant leg, wherein the at least one continuous groove is configured to receive the at least one continuous rib to form a waterproof interference fit, wherein the second annular gasket comprises a pull tab extending from a portion thereof, wherein the pull tab includes an open portion extending through a center of the pull tab, and wherein the pull tab is configured to decouple the first and second annular gaskets when a pull force is applied, and wherein the locator is positioned on the first flexible substrate so as to be capable of engaging the open portion in the pull tab, and wherein the locator is configured to engage the open portion in the pull tab, when the at least one continuous rib and the at least one continuous groove are aligned.

10. The system of claim 9, wherein the article of footwear is a boot, wherein the boot comprises a gaiter, and wherein the pant leg includes an inner liner and an outer shell.

11. The system of claim 10, wherein the gaiter is coupled to the first annular gasket and the inner liner is coupled to the second annular gasket.

* * * * *